US007471044B2

(12) United States Patent
Woo et al.

(10) Patent No.: US 7,471,044 B2
(45) Date of Patent: Dec. 30, 2008

(54) PLASMA DISPLAY PANEL HAVING AN ADDRESS ELECTRODE INCLUDING LOOP SHAPE PORTIONS

(75) Inventors: Seok-Gyun Woo, Suwon-Si (KR); Chong-Gi Hong, Suwon-Si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 566 days.

(21) Appl. No.: 11/087,699

(22) Filed: Mar. 24, 2005

(65) Prior Publication Data

US 2005/0225241 A1 Oct. 13, 2005

(30) Foreign Application Priority Data

Apr. 9, 2004 (KR) ..... 10-2004-0024484

(51) Int. Cl.
*H01J 17/49* (2006.01)

(52) U.S. Cl. ..... 313/586; 313/585

(58) Field of Classification Search ..... 313/582–587
See application file for complete search history.

(56) References Cited

U.S. PATENT DOCUMENTS

| | | | |
|---|---|---|---|
| 5,541,618 | A | 7/1996 | Shinoda |
| 5,661,500 | A | 8/1997 | Shinoda et al. |
| 5,663,741 | A | 9/1997 | Kanazawa |
| 5,674,553 | A | 10/1997 | Shinoda et al. |
| 5,724,054 | A | 3/1998 | Shinoda |
| 5,786,794 | A | 7/1998 | Kishi et al. |
| 5,952,782 | A | 9/1999 | Nanto |
| RE37,444 | E | 11/2001 | Kanazawa |
| 6,630,916 | B1 | 10/2003 | Shinoda |
| 6,707,436 | B2 | 3/2004 | Setoguchi et al. |
| 7,375,466 | B2 * | 5/2008 | Kwon et al. ..... 313/584 |

(Continued)

FOREIGN PATENT DOCUMENTS

| | | |
|---|---|---|
| JP | 02-148645 | 6/1990 |

(Continued)

OTHER PUBLICATIONS

Korean Office Action of the Korean Patent Application No. 2004-24484, issued on Apr. 27, 2006.

(Continued)

*Primary Examiner*—Toan Ton
*Assistant Examiner*—Bumsuck Won
(74) *Attorney, Agent, or Firm*—Robert E. Bushnell, Esq.

(57) ABSTRACT

A PDP (plasma display panel) includes: a front substrate; a rear substrate arranged opposite to the front substrate; front barrier ribs arranged between the front substrate and the rear substrate and formed of a dielectric material, the front barrier ribs partitioning discharge cells together with the front and rear substrates; front and rear discharge electrodes arranged within the front barrier ribs to surround the discharge cells, and extended in parallel along discharge cells of one row; address electrodes extended along discharge cells of another row intersecting with a row of the discharge cells where the front and rear discharge electrodes are arranged; phosphor layers arranged within the discharge cells; and a discharge gas injected in the discharge cells, in which the address electrode includes discharge portions formed in a loop shape disposed at the discharge cells and connecting portions connecting the discharge portions.

17 Claims, 5 Drawing Sheets

U.S. PATENT DOCUMENTS

| | | | | |
|---|---|---|---|---|
| 2003/0184226 | A1* | 10/2003 | Setoguchi et al. | 313/584 |
| 2004/0212303 | A1* | 10/2004 | Kao et al. | 313/582 |
| 2004/0245929 | A1* | 12/2004 | Sakamoto | 313/584 |
| 2005/0046353 | A1* | 3/2005 | Kwon et al. | 313/586 |
| 2005/0122045 | A1* | 6/2005 | Sung et al. | 313/582 |

FOREIGN PATENT DOCUMENTS

| | | |
|---|---|---|
| JP | 2845183 | 10/1998 |
| JP | 2917279 | 4/1999 |
| JP | 2001-043804 | 2/2001 |
| JP | 2001-084913 | 3/2001 |
| JP | 2001-325888 | 11/2001 |
| KR | 10-2001-0075758 | 8/2001 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

* cited by examiner

PLASMA DISPLAY PANEL HAVING AN ADDRESS ELECTRODE INCLUDING LOOP SHAPE PORTIONS

CLAIM OF PRIORITY

This application makes reference to, incorporates the same herein, and claims all benefits accruing under 35 U.S.C. §119 from an application for PLASMA DISPLAY PANEL earlier filed in the Korean Intellectual Property Office on 9 Apr. 2004 and there duly assigned Serial No. 10-2004-0024484.

BACKGROUND OF THE INVENTION

1. Field of the Invention

The present invention relates to a plasma display panel having a new structure and more particularly to a plasma display panel that can improve an address discharge.

2. Description of the Related Art

A plasma display panel (PDP) is a slim and light flat panel display that has large size, high definition, and wide viewing angle. Compared with other flat panel displays, the PDP can be simply manufactured in a large size and thus, is considered to be the next-generation large flat panel display.

The PDP is classified into a DC (direct current) type, an AC (alternating current) type, and a hybrid type according to a discharge voltage to be induced. Also, the PDP is classified into an opposite discharge type and a surface discharge type according to a discharge structure. An AC triode surface discharge PDP is widely used.

A conventional triode surface discharge PDP includes a front substrate and a rear substrate opposite to the front substrate.

Common electrodes and scan electrodes are formed below the front substrate. The common electrodes and the scan electrodes form a discharge gap. Also, the common electrodes and the scan electrodes are covered with a first dielectric layer. A protective layer is formed below the first dielectric layer.

Address electrodes are formed on the rear substrate and intersect with the common electrodes and the scan electrodes. The address electrodes are covered with a second dielectric layer. On the second dielectric layer, barrier ribs are spaced apart from one another by a predetermined distance that defines separating discharge spaces. Phosphor layers are formed in the discharge spaces and the discharge spaces are filled with a discharge gas.

In the PDP, ultraviolet rays are emitted from plasma generated by a discharge in the discharge space. The ultraviolet rays excite the phosphor layers and visible rays are emitted from the excited phosphor layers. In this manner, an image is displayed.

However, the electrodes, the first dielectric layer and the protective layer are sequentially formed on the front substrate absorb (about 40%) visible rays emitted from the phosphor layer. Thus, there is a limit in increasing the luminous efficiency of the PDP. In addition, if the same image is displayed for a long time, charged particles of the discharge gas are ion sputtered on to the phosphor layers, thus causing a permanent image sticking as there is a burn-in of the image on the PDP. Further, since a distance between the address electrode and the scan electrode is large and a width of the electrode of the address electrodes is small, there occurs a problem in an address discharge.

SUMMARY OF THE INVENTION

It is therefore, an object of the present invention to provide a PDP that can improve an address discharge.

It is another object of the present invention to provide a PDP that has improved luminous efficiency and reduced reactive power.

It is yet another object of the present invention to provide a PDP preventing ion sputtering of the phosphor due to the charged particles.

It is still another object of the present invention to provide a PDP that prevents burn-in of images on plasma display screen when a static image is displayed for a certain period of time.

According to an aspect of the present invention, there is provided a PDP including: a front substrate; a rear substrate arranged opposite to the front substrate; front barrier ribs arranged between the front substrate and the rear substrate and formed of a dielectric material, the front barrier ribs partitioning discharge cells together with the front and rear substrates; front and rear discharge electrodes arranged within the front barrier ribs to surround the discharge cells, and extended in parallel along discharge cells of one row; address electrodes extended along discharge cells of another row intersecting with a row of the discharge cells where the front and rear discharge electrodes are arranged; phosphor layers arranged within the discharge cells; and a discharge gas injected in the discharge cells, wherein the address electrode includes discharge portions formed in a loop shape disposed at the discharge cell and connecting portions connecting the discharge portions.

The discharge portion of the address electrode may be formed in a rectangular loop shape. In this case, the discharge portion of the address electrode may include vertical portions formed in the extended direction of the address electrode and horizontal portions connecting the vertical portions, wherein a width of the vertical portion may be smaller than a width of the horizontal portion. The width of the vertical portion may be in a range from 60 μm to 180 μm (microns), and the width of the horizontal portion may be in a range from 150 μm to 250 μm.

Also, the discharge portion of the address electrode may include vertical portions formed in the extended direction of the address electrode and horizontal portions connecting the vertical portions, wherein a width of the connecting portion is smaller than a width of the horizontal portion. In this case, the width of the connecting portion may be in a range from 70 μm to 200 μm, and the width of the horizontal portion may be in a range from 150 μm to 250 μm.

According to the present invention, a floating capacitance occurring between the adjacent address electrodes is reduced, thereby preventing a distortion of an address signal or an increase of a reactive power.

Also, since the address electrode surrounds the discharge cell, a distance between the address electrode and the scan electrode is reduced, such that an address discharge occurs well. If the width of the horizontal portion of the address electrode is formed relatively wide, an electrode area for the address discharge is widened, thereby improving the address discharge characteristic.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
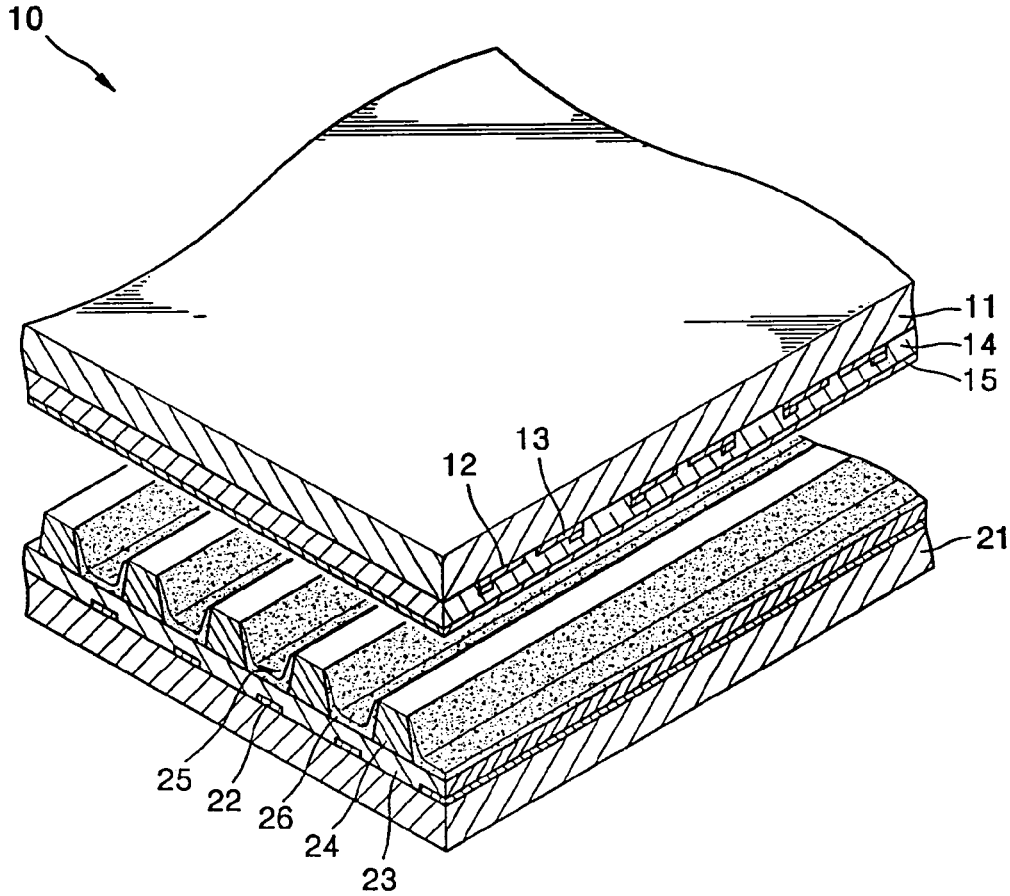
FIG. 1 (CONVENTIONAL ART)
FIG. 1 is an exploded perspective view of a conventional PDP.
Figure 2:
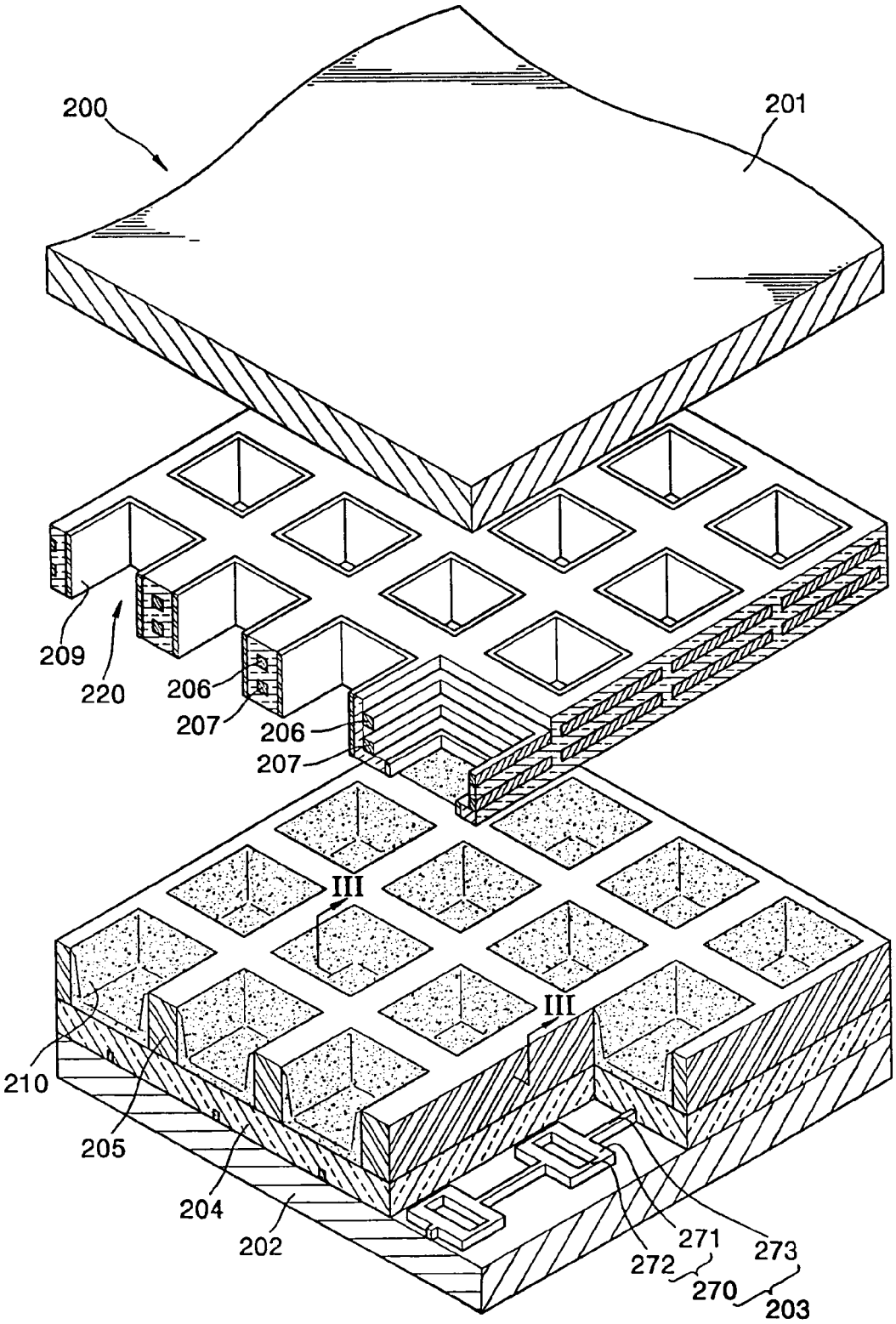
FIG. 2 is a partial cut-away exploded perspective view of a PDP according to an embodiment of the present invention.

Turning now to the drawings, FIG. 1 is an exploded perspective view of a conventional triode surface discharge PDP. Referring to FIG. 1, the triode surface discharge PDP includes a front substrate 11 and a rear substrate 21 opposite to the front substrate 11.

Common electrodes 12 and scan electrodes 13 are formed below the front substrate 11. The common electrodes 12 and the scan electrodes 13 form a discharge gap. Also, the common electrodes 12 and the scan electrodes 13 are covered with a first dielectric layer 14. A protective layer 15 is formed below the first dielectric layer 14.

Address electrodes 22 are formed on the rear substrate 21 and intersect with the common electrodes 12 and the scan electrodes 13. The address electrodes 22 are covered with a second dielectric layer 23. On the second dielectric layer 23, barrier ribs 24 are spaced apart from one another by a predetermined distance that defines separating discharge spaces 25. Phosphor layers 26 are formed in the discharge spaces 25 and the discharge spaces 25 are filled with a discharge gas.

In the PDP 10, ultraviolet rays are emitted from plasma generated by a discharge in the discharge space 25. The ultraviolet rays excite the phosphor layers 26 and visible rays are emitted from the excited phosphor layers 26. In this manner, an image is displayed.

However, the electrodes 12 and 13, the first dielectric layer 14 and the protective layer 15 are sequentially formed on the front substrate 11 absorb (about 40%) visible rays emitted from the phosphor layer 110. Thus, there is a limit in increasing the luminous efficiency of the PDP 10. In addition, if the same image is displayed for a long time, charged particles of the discharge gas are ion sputtered on to the phosphor layers 26, thus causing a permanent image sticking or burn-in. Further, since a distance between the address electrode 22 and the scan electrode 13 is large and a width of the electrode of the address electrodes 22 is small, there occurs a problem in an address discharge.

The present invention will now be described more fully with reference to the accompanying drawings, in which exemplary embodiments of the invention are shown.

A PDP according to an embodiment of the present invention will be described in detail with reference to FIGS. 2 through 5.

The PDP 200 includes a front substrate 201, a rear substrate 202 disposed in parallel to the front substrate 201, front barrier ribs 208 disposed between the front substrate 201 and the rear substrate 202 and formed of a dielectric material, the front barrier rib 208 partitioning discharge cells 220 together with the front and rear substrates 201 and 202, front discharge electrodes 206 and rear discharge electrodes 207 disposed within the front barrier ribs 208 to surround the discharge cells 220 and extended in parallel along the discharge cells of one row, rear barrier ribs 205 arranged between the front barrier ribs 208 and the rear substrate 202, phosphor layers 210 disposed within a space defined by the rear barrier ribs 205, address electrodes 203 arranged between the phosphor layers 210 and the rear substrate 203 and extended along the discharge cell of one row, intersecting with the front and rear discharge electrodes 206 and 207 in the discharge cell 220, and a discharge gas (not shown) injected in the discharge cell 220.

In this embodiment, since visible rays generated from the discharge cell 220 are emitted through the front substrate 201 to the outside, the front substrate 201 is formed of a material having good transmittance, such as a glass. A front transmittance of visible rays is remarkably improved because the front substrate 201 does not have the scan electrode 13 and the common electrode 12, the dielectric layer 14 covering the electrodes 12 and 13, and the protective layer 15, which have been formed on a front substrate of the conventional PDP 100. Accordingly, if an image is implemented to have a conventional brightness, the electrodes 12 and 13 are driven at a relatively low voltage, resulting in an increase of a luminous efficiency.

The front barrier ribs 208 are formed at a lower surface of the front substrate 201. Together with the front substrate 201 and the rear substrate 202, the front barrier ribs 208 partition the discharge cells 220 corresponding to one subpixel among a red subpixel, a green subpixel, and a blue subpixel, and prevents cross talk between the discharge cells 220.

The front barrier ribs 208 prevent the front discharge electrode 206 and the rear discharge electrode 207 from being directly electrically connected together during a discharge, and prevents charged particles from directly colliding with the electrodes 206 and 207, such that the electrodes 206 and 207 can be protected. The front barrier ribs 208 are formed of a dielectric material, such as PbO, $B_2O_3$ and $SiO_2$, which can guide the charged particles to accumulate wall charges.

Figure 4:
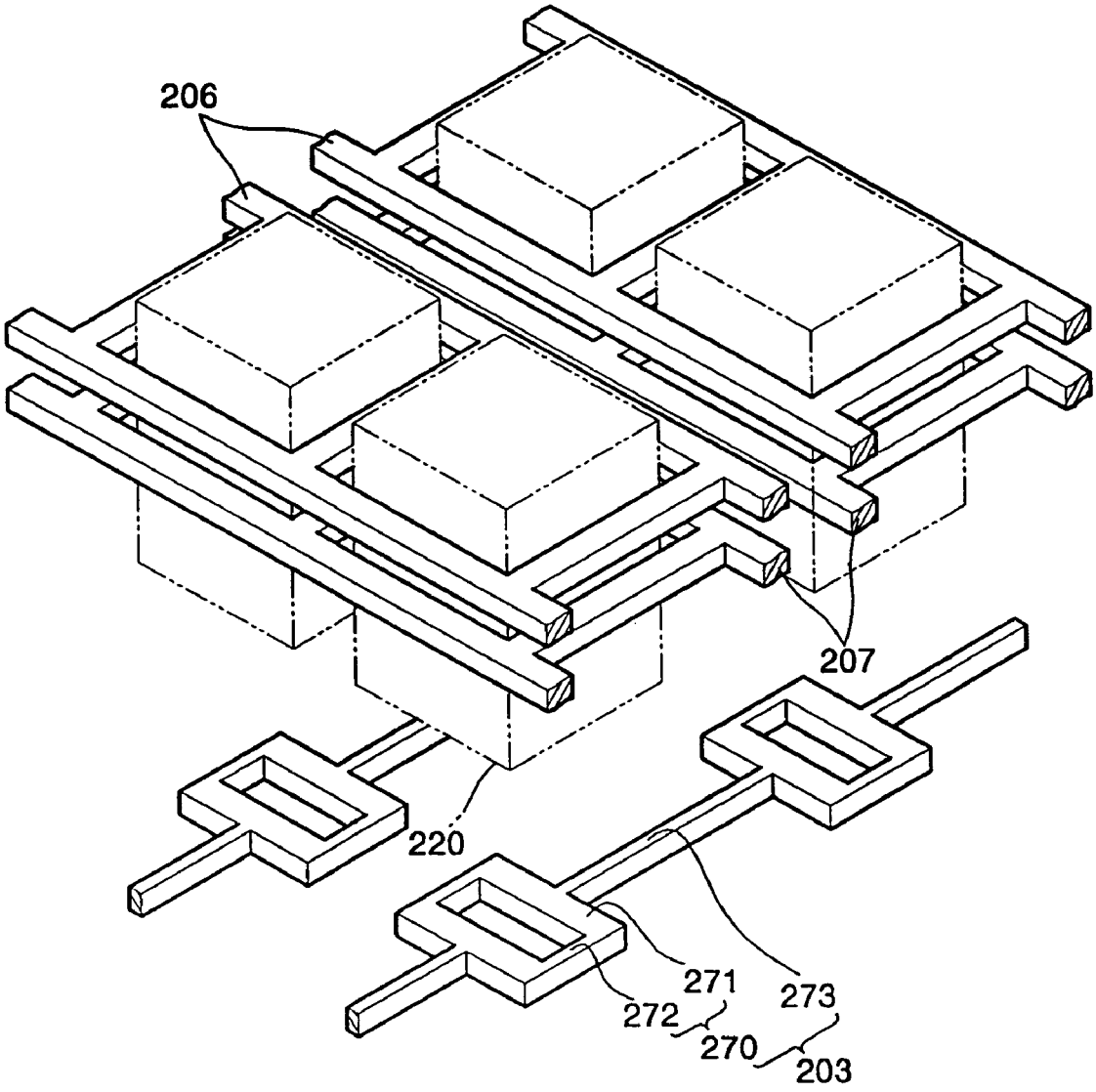
FIG. 4 is a perspective view of a discharge cell and electrodes shown FIG. 2.
Figure 5:
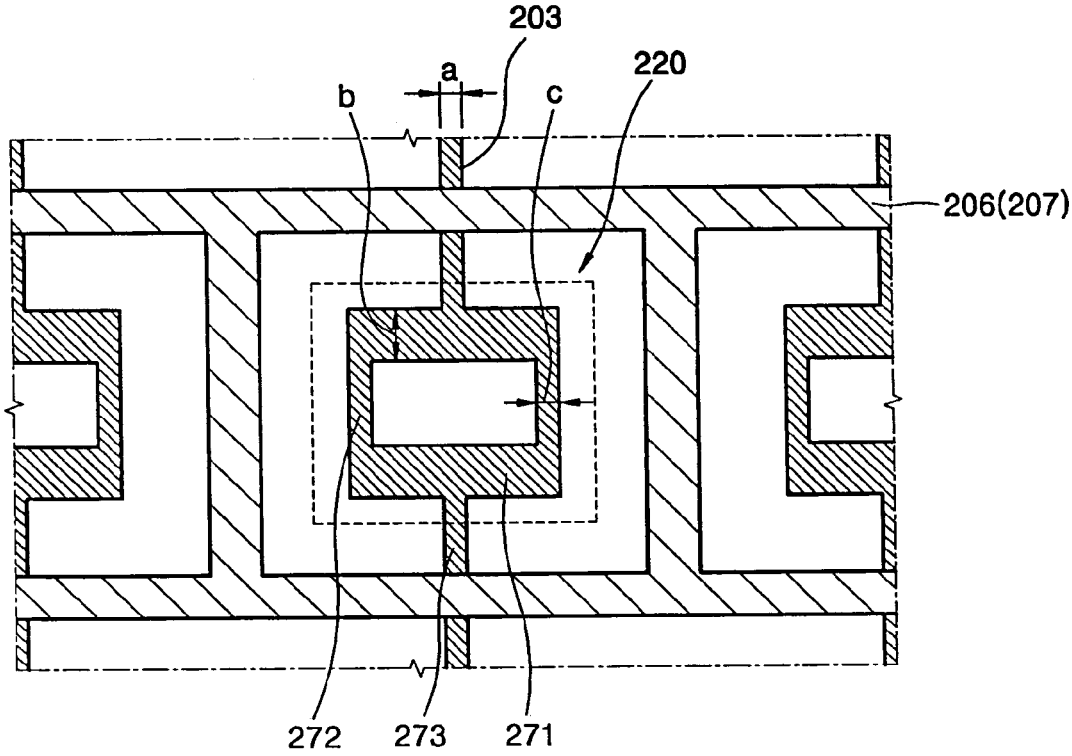
FIG. 5 is a plan view of an address electrode in the PDP shown in FIG. 2.

As shown in FIG. 4, the front and rear discharge electrodes 206 and 207 surrounding the discharge cells 220 are arranged in parallel in a direction perpendicular to the front substrate 201 and spaced apart from each other. Also, the front and rear discharge electrodes 206 and 207 are extended in parallel along the discharge cells 220 of one row. The front and rear discharge electrodes 206 and 207 can be formed of a conductive metal, such as aluminium and copper, and an erroneous operation due to the voltage drop can be prevented.

It is preferable that at least the sides of the front barrier rib 208 are covered with the MgO layer 209 serving as a protective layer. The MgO layer 209 can be formed by a deposition process which can be formed at the front barrier ribs, a lower surface of the front barriers and/or a lower surface of the front substrate between the discharge cells. Although the MgO layer 209 is not the requisite component, it can prevent the barrier ribs 208 from being damaged due to the collision of the charged particles with the barrier ribs 208 formed of a dielectric material. Also, the MgO layer 209 emits a lot of secondary electrons during the discharge.

The rear substrate 202 supports the address electrodes 203, the dielectric layer 204 and the rear barrier ribs 205, and is formed of a material whose main component is glass.

On the rear substrate 202 arranged opposite to the front substrate 201, the address electrodes 203 are extended along the discharge cells of another row intersecting with the row of the discharge cells where the front and rear discharge electrodes 206 and 207 are arranged. Therefore, the address electrodes 203 are actually intersected with the front and second discharge electrodes 206 and 207.

The address electrode 203 includes discharge portions 270 formed in a rectangular loop shape, and a connecting portion 273 connecting the discharge portions 270. Also, each of the discharge portions 270 includes vertical portions 272 formed in the extended direction of the address electrode 203, and horizontal portions 271 connecting the vertical portions 272.

The address electrode 203 initiates an address discharge to make it easier to initiate a sustain discharge between the front discharge electrode 206 and the rear discharge electrode 207. That is, the address electrode 203 reduces a voltage at which the sustain discharge starts. The address discharge occurs between the scan electrode and the address electrode. When the address discharge is finished, positive ions are accumulated on the scan electrode and electrons are accumulated on the common electrode. Thus, the sustain discharge between the scan electrode and the common electrode occurs easier.

The rear discharge electrode 207 close to the address electrode 203 serves as the scan electrode, and the front discharge electrode 206 serves as the common electrode, since the address discharge occurs efficiently when the gap between the scan electrode and the address electrode is narrower.

In the PDP 200, a width "c" of the vertical portion 272 can be formed smaller than a width "b" of the horizontal portion 271. In this structure, since an electrode area cross-talked between the vertical portions 272 of the adjacent address electrodes 203 is reduced, a floating capacitance is reduced. The floating capacitance is reduced because the floating capacitance is inversely proportional to a distance between the adjacent address electrodes and is proportional to a corresponding electrode area. Accordingly, the PDP of the present invention can solve the problem in that the floating capacitance causes a distortion of an address signal or an increase of a reactive power. Also, if the width "b" of the horizontal portion 271 is wider than that of the vertical portion 272, an electrode area for the address discharge is increased. Thus, an amount of wall charges is increased in the address discharge, such that the address discharge occurs well. It is preferable that the width "c" of the vertical portion is in a range from 60 μm to 180 μm (microns or micrometers) and the width "b" of the horizontal portion is in a range from 150 μm to 250 μm.

Also, the width "a" of the connecting portion can be formed smaller than the width "b" of the horizontal portion. In this case, as described above, the floating capacitance occurring between the adjacent address electrodes 203 is reduced, thereby preventing a distortion of an address signal or an increase of a reactive power. Also, if the width "b" of the horizontal portion 271 is large, an electrode area for the address discharge is increased and thus the address discharge occurs well. It is preferable that the width "a" of the connecting portion is in a range from 70 μm to 200 μm and the width "b" of the horizontal portion is in a range from 150 μm to 250 μm.

The dielectric layer 204 interposed between the phosphor layer 210 and the rear substrate 202 and burying (or embedding) the address electrode 203 is formed of a dielectric material, such as PbO, $B_2O_3$ and $SiO_2$, which can guide charges and also prevent the damage of the address electrode 203 due to the collision of positive ions or electrons with the address electrode 203 during the discharge.

In this embodiment, the rear barrier ribs 205 are arranged between the front barrier ribs 208 and the dielectric layer 204 and defines a space therebetween. Although the front and rear barrier ribs 208 and 205 are formed in a matrix in FIG. 2, the present invention is not limited to this structure. That is, if only a plurality of discharge spaces can be formed, the barrier ribs can be formed in various types, for example, open barrier ribs such as a stripe type, and a closed barrier ribs such as a waffle, matrix or delta type. Also, in a cross section of the discharge cell, the closed barrier ribs can be formed in a polygon, such as a rectangular, triangular or pentagonal shape, or a circular or elliptic shape. The front and rear barrier ribs 208 and 205 can be formed in the same shape or in the different shape. Also, the front barrier ribs 208 and the rear barrier ribs 205 may be formed in one body.

Phosphor layers 210 are arranged in a space defined by the rear barrier ribs 205. The phosphor layers 210 receives ultraviolet rays generated by the discharge between the front and rear discharge electrodes 206 and 207 and emits visible rays. The phosphor layers formed at the red subpixel contain a phosphor, such as $Y(V,P)O_4$:Eu; the phosphor layers formed at the green subpixel contain a phosphor, such as $Zn_2SiO_4$:Mn and $YBO_3$:Tb; and the phosphor layers formed at the blue subpixel contain a phosphor, such as BAM:Eu.

The discharge cells 220 are filled with a discharge gas, such as Ne, Xe and a mixed gas thereof. According to the present invention, the discharge surface can be increased and the discharge area can be extended, so that an amount of plasma increases. Therefore, a low voltage driving is possible. Since the present invention can achieve the low voltage driving even when a high-concentration Xe gas is used as the discharge gas, the luminous efficiency can be remarkably improved. Consequently, the present invention can solve the problem of the conventional PDP where the low voltage driving is difficult when the high-concentration Xe gas is used as the discharge gas.

In the above-described PDP 200, the address discharge is initiated by applying the address voltage between the address electrode 203 and the rear discharge electrode 207. As a result of the address discharge, the discharge cell 220 for the sustain discharge is selected.

Thereafter, an AC sustain voltage is applied between the front discharge electrode 206 and the rear discharge electrode 207 of the selected discharge cell 220, the sustain discharge occurs therebetween. Due to the sustain discharge, an energy level of the excited discharge gas is lowered and thus ultraviolet rays are emitted. The ultraviolet rays excite the phosphor layer 210 disposed within the discharge cell 220 and the energy level of the excited phosphor layer 210 is lowered to emit the ultraviolet rays, thereby forming an image.

According to the conventional PDP shown in FIG. 1, the sustain discharge between the scan electrode 13 and the common electrode 12 occurs in a horizontal direction, so that the discharge area is relatively narrow. However, according to the present invention, the sustain discharge of the PDP occurs on all the sidewalls partitioning the discharge cell 220, so that the discharge area is relatively wide.

Also, the sustain discharge is formed along the sides of the discharge cell 220 and is gradually spread toward the central portion of the discharge cell 220. Thus, a volume of an area where the sustain discharge occurs is increased and the space charges in the discharge cell also attribute to the discharge. This results is the improvement of the luminous efficiency of the PDP.

Figure 3:
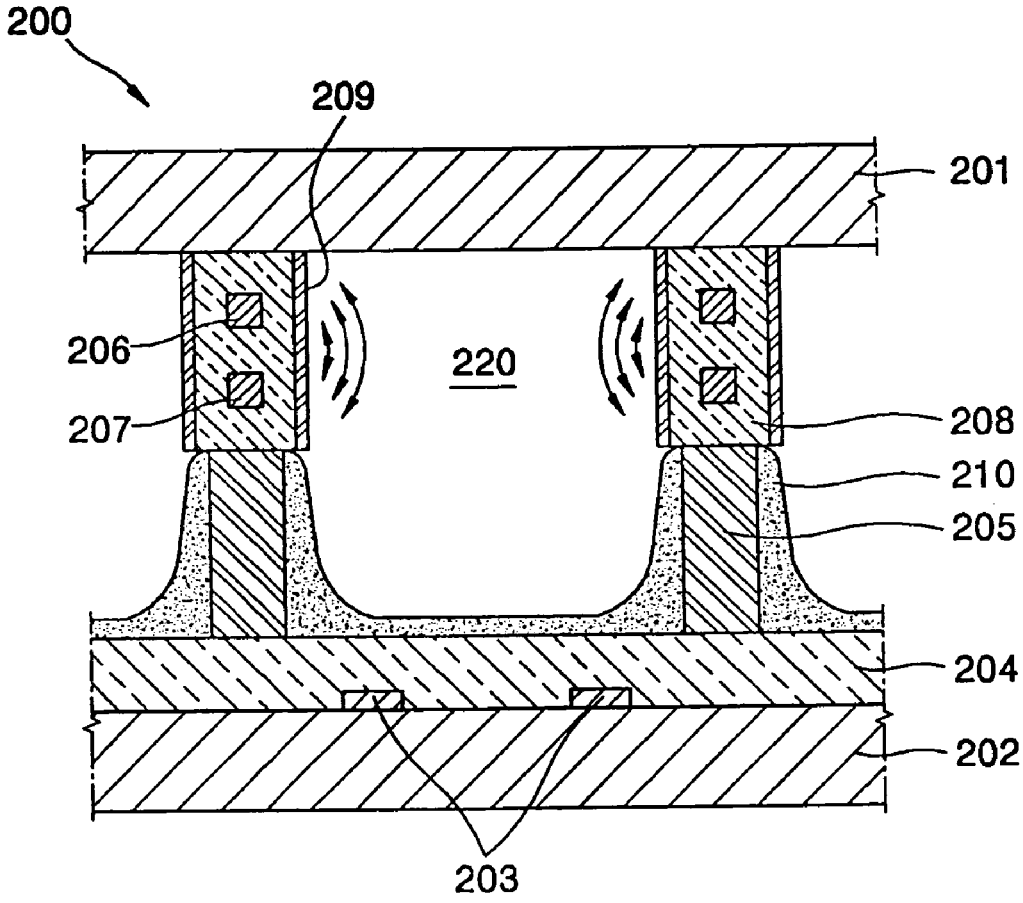
FIG. 3 is a sectional view taken along line III-III of FIG. 2.

As shown in FIG. 3, the sustain discharge occurs only in the area limited by the front barrier ribs 208. Therefore, the ion sputtering of the phosphor due to the charged particles can be prevented and the permanent image sticking or burn-in does not appear when the same image is displayed for a long time.

Accordingly, the PDP of the present invention can be manufactured to have improved luminous efficiency and reduced reactive power.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A plasma display panel, comprising:

a front substrate;

a rear substrate arranged opposite to said front substrate;

front barrier ribs arranged between said front substrate and said rear substrate and formed of a dielectric material, said front barrier ribs partitioning discharge cells together with said front and rear substrates;

front and rear discharge electrodes arranged within said front barrier ribs to surround the discharge cells, and extended in parallel along discharge cells of one row;

address electrodes extended along discharge cells of another row intersecting with a row of the discharge cells where the front and rear discharge electrodes are arranged;

phosphor layers arranged within the discharge cells; and a discharge gas injected in the discharge cells, wherein said address electrode comprises discharge portions formed in a rectangular loop shape disposed at the discharge cells, and connecting portions connecting the discharge portions, wherein the discharge portion of the address electrode comprises vertical portions formed in the extended direction of the address electrode and horizontal portions connecting the vertical portions, and a width of the vertical portion is smaller than a width of said horizontal portion to reduce an electrode area cross-talk with the vertical portion of an adjacent address electrode and reducing floating capacitance.

2. The plasma display panel of claim 1, wherein the width of the vertical portion is in a range from 60 μm to 180 μm.

3. The plasma display panel of claim 1, wherein the width of the horizontal portion is in a range from 150 μm to 250 μm.

4. The plasma display panel of claim 1, wherein the discharge portion of the address electrode includes vertical portions formed in the extended direction of said address electrode and horizontal portions connecting the vertical portions, and a width of the connecting portion is smaller than a width of said horizontal portion.

5. The plasma display panel of claim 4, wherein the width of the connecting portion is in a range from 70 μm to 200 μm.

6. The plasma display panel of claim 4, wherein the width of the horizontal portion is in a range from 150 μm to 250 μm.

7. The plasma display panel of claim 1, further comprising rear barrier ribs arranged between said front barrier ribs and the rear substrate.

8. The plasma display panel of claim 7, wherein the phosphor layers are arranged within a space defined by said rear barrier ribs.

9. The plasma display panel of claim 7, wherein said front barrier ribs and the rear barrier ribs are formed in one body.

10. The plasma display panel of claim 1, further comprising a dielectric layer covering said address electrodes.

11. The plasma display panel of claim 1, wherein the address electrodes are arranged on said rear substrate opposite to said front substrate.

12. The plasma display panel of claim 1, wherein said front and rear discharge electrodes are spaced apart in a direction perpendicular to said front substrate.

13. The plasma display panel of claim 1, wherein at least a side of said front barrier ribs is covered by a protective layer.

14. A plasma display panel, comprising:

a front substrate;

a rear substrate disposed opposite to said front substrate;

a plurality of front barrier ribs arranged between said front substrate and said rear substrate and formed of a dielectric material, said front barrier ribs partitioning discharge cells together with said front and rear substrates;

a plurality of front and rear discharge electrodes arranged within said front barrier ribs to surround the discharge cells, and extended along discharge cells of a first row; and a plurality of address electrodes extended along discharge cells of a second row intersecting with the first row of the discharge cells where the front and rear discharge electrodes are arranged, each one of said address electrodes comprises discharge portions formed in a polygonal ring shape disposed at the discharge cells, and connecting portions connecting the discharge portions, wherein the discharge portion of the address electrode comprises vertical portions formed in the extended direction of the address electrode and horizontal portions connecting the vertical portions, and a width of the vertical portion is smaller than a width of said horizontal portion and a width of said connecting portion is smaller than the width of said horizontal portion, and at least a side of said front barrier ribs is covered by a protective layer to reduce an electrode area cross-talk between the vertical portion of an adjacent address electrode and reducing floating capacitance.

15. The plasma display panel of claim 14, further comprising rear barrier ribs arranged between said front barrier ribs and the rear substrate, the front and rear barrier ribs forming any one of a matrix, delta type, waffle type and a stripe type shape, where in a cross section of the discharge cell, the waffle, matrix and delta type formed in any one of polygon, circular and elliptical shape.

16. A plasma display panel, comprising:

a first substrate;

a second substrate arranged opposite to said first substrate;

first barrier ribs formed between said first substrate and said second substrate and formed of a dielectric material, said first barrier ribs partitioning discharge cells together with said first and second substrates, said first barrier ribs formed at a lower surface of said first substrate;

first and second discharge electrodes embedded within said first barrier ribs to surround the discharge cells, and extended in parallel along discharge cells of one row, said first and second discharge electrodes formed of a conductive metal; and address electrodes extended along discharge cells of another row intersecting with a row of the discharge cells where the first and second discharge electrodes are arranged, with the discharge cells including phosphor layers and discharge gas, said address electrode comprises discharge portions formed in a polygonal loop shape disposed at the discharge cells, and connecting portions connecting the discharge portions, wherein the discharge portion of the address electrode comprises vertical portions formed in the extended direction of the address electrode and horizontal portions connecting the vertical portions, and a width of the vertical portion is smaller than a width of said horizontal portion and a width of said connecting portion is smaller than the width of said horizontal portion to reduce an electrode area cross-talk between the vertical portion of an adjacent address electrode and reducing floating capacitance.

17. The plasma display panel of claim 16, wherein the width of the vertical portion is in a range from 60 μm to 180 μm, the width of the horizontal portion is in a range from 150 μm to 250 μm, and the width of the connecting portion is in a range from 70 μm to 200 μm.

* * * * *